US010667553B2

(12) United States Patent
Sanchez et al.

(10) Patent No.: US 10,667,553 B2
(45) Date of Patent: Jun. 2, 2020

(54) METHOD, COMPOSITION AND APPARATUS FOR FUNCTIONALIZATION OF AEROSOLS FROM NON COMBUSTIBLE SMOKING ARTICLES

(71) Applicant: LOEC, INC., Greensboro, NC (US)

(72) Inventors: Luis A. Sanchez, Greensboro, NC (US); Kai Tang, Chapel Hill, NC (US); Steven E. Brown, Oak Ridge, NC (US)

(73) Assignee: Fontem Holdings 4 B.V., Amsterdam (NL)

( * ) Notice: Subject to any disclaimer, the term of this patent is extended or adjusted under 35 U.S.C. 154(b) by 648 days.

(21) Appl. No.: 14/763,138

(22) PCT Filed: Jan. 24, 2014

(86) PCT No.: PCT/US2014/012984

§ 371 (c)(1),
(2) Date: Jul. 23, 2015

(87) PCT Pub. No.: WO2014/116974

PCT Pub. Date: Jul. 31, 2014

(65) Prior Publication Data

US 2015/0374035 A1 Dec. 31, 2015

(51) Int. Cl.
*A24F 47/00* (2020.01)
*A24B 15/167* (2020.01)

(52) U.S. Cl.
CPC ..... *A24F 47/002* (2013.01); *A24B 15/167* (2016.11); *A24F 47/008* (2013.01)

(58) Field of Classification Search
CPC ... A24F 47/008; A61M 15/06; A61M 11/042; A61M 11/044; A24D 3/00
See application file for complete search history.

(56) References Cited

U.S. PATENT DOCUMENTS

2002/0166563 A1* 11/2002 Jupe ..... A24D 3/048 131/331
2005/0016550 A1* 1/2005 Katase ..... A24F 47/002 131/194

(Continued)

FOREIGN PATENT DOCUMENTS

EP 3042577 A1 7/2016
WO 2015013108 A2 1/2015

(Continued)

*Primary Examiner* — Tulsidas C Patel
*Assistant Examiner* — Marcus E Harcum
(74) *Attorney, Agent, or Firm* — Dykema Gossett PLLC

(57) ABSTRACT

An apparatus and method for delivering an aerosol-forming composition and a separate functional composition for generating a functionalized aerosol vapor which emulates the organoleptic characteristics and properties of mainstream smoke experienced by smoking traditional tobacco-based smoking articles. The apparatus comprises an aerosol-forming liquid which is adapted to deliver aerosol-forming liquid to a heating device and a downstream chamber or zone containing an functional composition comprising one or more organoleptic components such as a taste, fragrance and/or nicotine delivery components. The method comprises generating an aerosol from an aerosol forming liquid and functionalizing the aerosol by subjecting the aerosol to a matrix for the purpose of transferring, delivering or imparting one or more organoleptic properties.

18 Claims, 9 Drawing Sheets

(56) References Cited

U.S. PATENT DOCUMENTS

| | | | | |
|---|---|---|---|---|
| 2006/0196518 | A1* | 9/2006 | Hon | A24F 47/002 131/360 |
| 2008/0092912 | A1* | 4/2008 | Robinson | A24F 47/008 131/200 |
| 2011/0036363 | A1* | 2/2011 | Urtsev | A24F 47/002 131/273 |
| 2012/0006346 | A1* | 1/2012 | Inagaki | A24F 47/004 131/329 |
| 2012/0042885 | A1* | 2/2012 | Stone | A24B 15/165 131/194 |
| 2013/0192620 | A1 | 8/2013 | Tucker et al. | |
| 2013/0306085 | A1* | 11/2013 | Sanchez | A24D 3/04 131/344 |
| 2014/0166029 | A1 | 6/2014 | Weigensberg et al. | |
| 2014/0261486 | A1 | 9/2014 | Potter et al. | |
| 2014/0334804 | A1* | 11/2014 | Choi | A61M 15/06 392/404 |
| 2015/0027468 | A1 | 1/2015 | Li et al. | |
| 2015/0027469 | A1 | 1/2015 | Tucker et al. | |
| 2015/0374035 | A1 | 12/2015 | Sanchez | |
| 2016/0073695 | A1 | 3/2016 | Sears et al. | |
| 2016/0206003 | A1 | 6/2016 | Yamada et al. | |
| 2016/0206004 | A1* | 7/2016 | Shinkawa | A24F 47/008 |
| 2017/0265517 | A1* | 9/2017 | Swede | A24B 15/16 |
| 2018/0007966 | A1* | 1/2018 | Li | A24F 47/008 |

FOREIGN PATENT DOCUMENTS

| | | | |
|---|---|---|---|
| WO | 2015179388 | A1 | 11/2015 |
| WO | 2016062777 | A1 | 4/2016 |
| WO | 2016121143 | A1 | 4/2016 |
| WO | 2016069903 | A1 | 5/2016 |
| WO | 2016075748 | A1 | 5/2016 |
| WO | 2016076178 | A1 | 5/2016 |

* cited by examiner

METHOD, COMPOSITION AND APPARATUS FOR FUNCTIONALIZATION OF AEROSOLS FROM NON COMBUSTIBLE SMOKING ARTICLES

FIELD OF THE INVENTION

The present invention relates to methods, compositions and apparatus for generating a functionalized aerosol which emulates the organoleptic characteristics and properties of mainstream smoke generated by traditional tobacco-based smoking articles.

BACKGROUND

Electronic cigarettes are a popular alternative to traditional smoking articles that burn tobacco products to generate mainstream smoke for inhalation. Unlike traditional tobacco-based smoking articles, electronic cigarettes generate an aerosol-based vapor for inhalation which generally emulates mainstream smoke of traditional tobacco based smoking articles. However, it is generally recognized that aerosol-based vapor generated by electronic cigarettes does not deliver the same "quality" of experience as traditional smoking articles. Applicants have found that this deficiency in the "quality" of experience results, at least in part, from the use of a composite aerosol forming liquid solution to generate the aerosol-based vapor. More specifically, the composite aerosol forming liquid solution includes an aerosol forming liquid and one or more taste, fragrance or nicotine delivery compositions. Among other things, it is believed that the use of such a composite aerosol forming liquid solution may result in the formation of chemically or pharmacological incompatible components. Furthermore, it is believed that interactions among the various components of the composite aerosol forming liquid solution may cause chemical, pharmacological, and/or thermal instability, which, in turn, may result in particulate precipitation, fouling of the aerosol heating element or chemical degradation of the solution, as well as other constraints to aerosol vapor delivery. Each of these deficiencies compromises the organoleptic performance and quality of the aerosol based vapor generated by the electronic cigarettes. Accordingly, it is desirable to provide improved methods, compositions and apparatus for generating functionalized aerosols having enhanced organoleptic characteristics and properties which more closely emulate the smoking experience provided by the mainstream smoke from traditional tobacco-based smoking articles.

SUMMARY OF THE INVENTION

An objective of the invention is to provide a method, composition and apparatus for generating a functionalized aerosol vapor which emulates the organoleptic characteristics and properties of mainstream smoke experienced by users smoking traditional tobacco-based smoking articles.

It is a further objective of the invention to provide a method comprising a two-step process for the formation of a functionalized aerosol vapor. The first step of the process involves generating an aerosol from an aerosol forming liquid. The second step of the process involves functionalizing the aerosol by subjecting the aerosol to a matrix for the purpose of transferring, delivering or imparting one or more organoleptic properties such as taste, fragrance and/or nicotine delivery to the aerosol.

It is yet a further objective of the present invention to provide a method wherein the first step of generating an aerosol comprises providing an optimal aerosol particulate size distribution for the desired fragrance, taste, and/or nicotine delivery properties subsequently imparted on the aerosol in the second step of the process.

It is yet a further objective of the present invention to provide a method wherein the first step of the process comprises generating an aerosol having properties for optimizing the taste, fragrance and/or nicotine delivery characteristics to the aerosol during the second step of the inventive method. For example, the aerosol forming liquid may comprise an excipient such as water which forms an aerosol having properties for activating exothermic or endothermic reactions during the second step of the process.

It is yet another objective of the present invention to provide a method wherein the aerosol vapor pressure is used as a mechanism for transferring, delivering or imparting taste, fragrance and/or nicotine characteristics during the second step of the process.

It is yet a further objective of this invention to provide an aerosol-forming composition and a separate functional composition for generating a functionalized aerosol vapor with emulates the organoleptic characteristics and properties of mainstream smoke experienced by smoking traditional tobacco-based smoking articles. For example, the aerosol-forming composition may comprise ethanol, glycerol, propylene glycol, polyethylene glycol, water or mixtures thereof. The functional composition may comprise one or more organoleptic components such as taste, fragrance, and/or nicotine delivery components. For example, the functional composition may comprise a solution or dispersion having taste and/or nicotine delivery components. Alternatively, the functional composition may comprise encapsulated taste and/or fragrance delivery components. Moreover, the functional composition may comprise a gel having taste, fragrance and/or nicotine delivery components.

According to another aspect of the present invention, the taste, fragrance and/or nicotine composition may comprise a vapor pressure modifier such as ethanol.

It is yet a further objective of the present invention to provide an apparatus for generating a functionalized aerosol vapor which emulates the organoleptic characteristics and properties of mainstream smoke experienced by smoking traditional tobacco-based smoking articles. In one embodiment, the apparatus comprises a first chamber or zone containing an aerosol-forming liquid which is adapted to deliver aerosol-forming liquid to a heating device. The apparatus further comprises a downstream chamber or zone containing an functional composition comprising one or more organoleptic components such as a taste, fragrance and/or nicotine delivery components.

According to a further objective of the present invention, the apparatus may comprise a functional component insert in the proximity of the mouth piece. For example, the apparatus may comprise a disposable fragrance insert in the proximity of the mouth piece designed to deliver the same number of puffs of a traditional cigarette. It will be understood that such an insert could also be adapted to deliver of any other organoleptic property such as taste or nicotine delivery.

Another objective of the present invention is to simplify the filling of flavored cartridges during e-Cigarette manufacturing and therefore increasing manufacturing capacity since it is easier to have filling stations dedicated to flavored and unflavored formulations.

It is a further objective of the present invention to provide an electronic smoking article having discrete repositories for the aerosol forming liquid solutions and the taste, fragrance and/or nicotine solution to provide for a prolonged shelf life for the respective solutions and extended operating life of the electronic cigarette atomizer heating element.

DETAILED DESCRIPTION OF THE INVENTION

Figure 1:
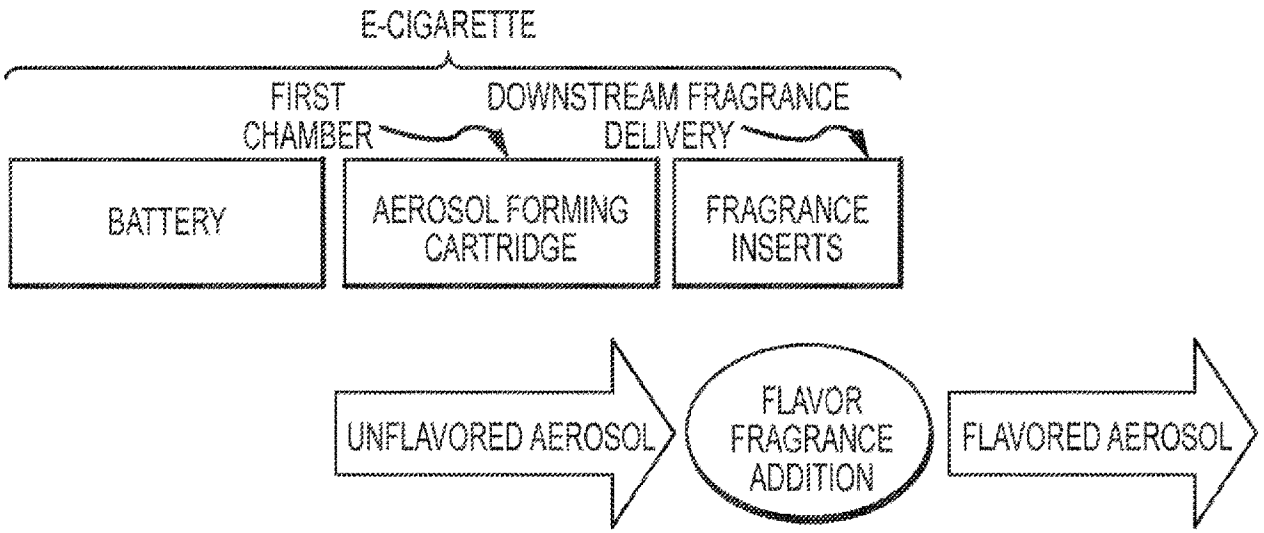
FIG. 1 is a block diagram of a fragrance insert being used in an e-cigarette.

According to one aspect of the present invention, a two-step process is used to form an aerosol with organoleptic properties suitable to be delivered with e-cigarettes. In the first step of the process, an aerosol is formed from a non-flavored formulation located in a first chamber or zone of the e-cigarette. Any aerosol formation mechanism (e.g., thermal, mechanical, piezoelectric) may be used in the present invention. The aerosol is then subjected to a taste, fragrance and/or nicotine carrying matrix adapted to transfer the desired organoleptic properties to the aerosol. During this step, taste, fragrance and/or nicotine delivery components in a high vapor pressure solvent are released into the aerosol prior to exiting the e-cigarette mouth piece. The sketch below shows this two-step process wherein a fragrance insert is employed to deliver fragrance to the e-cigarette aerosol.

The formation of an unflavored aerosol in an e-cigarette may involve any known nebulizer mechanism. For example, ultrasonic wave nebulization (with a piezoelectric element vibrating and creating high-frequency ultrasound waves to cause vibrations and atomization of liquid formulations), electric nebulization (with a heating element built on a high surface component in direct contact with an aerosol forming material), or spraying jet atomization by passing an aerosol solution through small venturi injection channels. In general, the aerosol characteristics depend on the rheological and thermodynamics properties of the aerosol forming liquid as well as the nebulization mechanism. Because of physical chemical stresses (i.e. thermal degradation, shear induced phase separation, etc.) of the aerosol forming material during nebulization, the aerosol characteristics and delivery consistency can be affected when the liquid is nebulized. This is very relevant to aerosol quality if the affected aerosol material component is organoleptic. For example, nicotine might degrade under thermal nebulization; menthol and other hydrophobic taste material might precipitate due to incompatibility with hydrophilic forming aerosol formulations. In other cases, desirable organoleptic materials, i.e. menthol, tobacco extracts, etc., can be insoluble in the aerosol forming liquid at the appropriate viscosity and/or surface tension to deliver an acceptable aerosol, therefore, limiting the amount of delivered organoleptic. Furthermore, improvements to the consistency of aerosol delivery might be possible with this strategy because the organoleptic material—which are absent during aerosol formation—would not affect the viscosity and the surface tension. These material variables affect aerosol particle size distribution. Having an aerosol formation process prior to flavoring insures aerosol consistency, in particular, when it is desirable to deliver a consistent nicotine amount by the aerosol exiting the mouth piece of the e-cigarette.

Therein, that an unflavored aerosol formulation, located in the first chamber or zone, suitable to form aerosols with particle size distribution and deliver desired user experience, and that can be later further tailored for organoleptic delivery is attractive to e-cigarette manufacturers. Base aerosol formulations suitable for the present invention comprise aerosol forming materials, vapor pressure modifiers, buffers, salts, nucleation site structures, surfactants, preservatives, and an excipient. Furthermore, any of the components that form the unflavored aerosol formulation can be used to trigger chemically another component located downstream the nebulizer. For example, water can be used to activate exothermic or endothermic reactions of salts located in a downstream insert to induce heat changes that either heat a sublimable material insert or change deliverable aerosol particle size distribution. Non-limiting examples of unflavored aerosol forming formulations are included in Table I below.

TABLE 1

Aerosol Formulations

| Function | Component: Example | Range (%) | Formulation Examples (%) 1 | 2 | 3 | 4 | 5 |
|---|---|---|---|---|---|---|---|
| Aerosol Former | Glycols | 0-90 | 60 | 60 | 60 | | |
| Aerosol Former | Glycerin | 0-90 | 10 | | 20 | 60 | 60 |
| Vapor Pressure Modifier | Ethanol | 0-30 | | 20 | | | 10 |
| Nucleation Site | Salts: NaCl, Particle Dispersion, etc. | 0-10 | | 1 | | 1 | |
| Surfactant, Particle Size Control | Pharmaceutical Surfactants: Lecithin, Tweens, etc. | 0-5 | | 1 | 1 | 1 | |
| Buffer | Citrates, Phosphates Salt-Acid Pair | 0-10 | | 3 | 2 | 3 | |
| Preservatives | Alkyl Hydroxyanisole or Hydroxytoluene, etc. | 0-3 | 1 | 1 | 1 | 1 | 1 |
| Excipient | Water | q.s. ad | 29 | 14 | 16 | 14 | 29 |

Organoleptic Functionalized Formulations

Taste, fragrance and/or nicotine carrying matrix formulations, applicable to this invention to change the organoleptic properties of the delivered aerosol are presented in the embodiments below. These formulations can be liquids, dispersions, gels, encapsulate fragrances, fibers or any other forms and shapes that allow intimate contact with the unflavored aerosol stream. These formulations may have a high vapor pressure to allow maximizing their fragrance contribution to the aerosol stream. Illustrative examples of functionalized formulations which may be incorporated in the e-cigarette are presented below.

Fragrance Delivery

The major formulation components in this embodiment, when the formulation is in a liquid state, consist of a fragrance, a vapor pressure modifier, a preservative and an excipient. These formulations might also contain other components to further modify the delivered aerosol stream such as surfactants, nucleation sites, buffers, etc. Table II shows non-limiting examples for solutions, dispersions, encapsulates and gel formulation physical forms. These formulations might contain nicotine as required by a final aerosol delivery specification.

TABLE II

| Functionalized Formulations | | | | | | | |
|---|---|---|---|---|---|---|---|
| | | | Range | Formulation Examples (%) | | | |
| Function | Component Example | Form | (%) | 1 | 2 | 3 | 4 |
| Organoleptic | Pina Colada, Cherry, Coffee, etc. | Solution, Dispersion | 0-100 | | 10 | | |
| | Tobacco Extract | Solution, Dispersion | 0-100 | 50 | | | |
| | Fragrance/Menthol | Encapsulate Fibers | 0-100 | | | 100 | |
| | Fragrance/Taste/Tobacco Extract | Gel | 0-100 | | | | 100 |
| Vapor Pressure Modifier | Ethanol | | 0-30 | | | | |
| Nucleation Site Structures | Salts: NaCl, Dispersion | | 0-10 | 5 | 5 | | |
| Surfactant, Aerosol Particle Size Control | Lecithin, Tweens, etc. | | 0-5 | 3 | 3 | | |
| Buffer | Citrates, Phosphates Salt-Acid Pair, etc. | | 0-10 | 5 | 5 | | |
| Preservatives | Alkyl Hydroxyanisole or Hydroxytoluene, etc. | | 0-30 | 1 | 2 | | |
| Liquid Excipient | Water, Glycol, Glycerin, etc. | | q.s. ad | 30 | 75 | | |

Low Solubility/Hydrophobic Organoleptic Fragrance Delivery

When the solubility of the organoleptic material is low, there is a limit to the amount of organoleptic in an aerosol compatible formulation. By placing the organoleptic downstream from the aerosol forming part of the e-cigarette, it is possible to have formulations with high concentration of delivered organoleptics since they are not constrained by their low solubility in aerosol forming formulations. The formulation components in this embodiment can consist of a fragrance, a vapor pressure modifier, a preservative and an excipient. These formulations might also contain other components to further modify the delivered aerosol stream such as surfactants, nucleation sites, buffers, etc. The table below shows non-limiting examples for liquids, solutions and dispersions.

TABLE III

| Functionalized Formulations | | | | | | |
|---|---|---|---|---|---|---|
| | Component | | Range | Formulation Examples (%) | | |
| Function | Example | Form | (%) | 1 | 2 | 3 |
| Organoleptic | Menthol Solution | Liquid | 0-100 | 20 | 10 | 10 |
| | Tobacco Extract | Solution, Dispersion | 0-100 | | 40 | |
| | Fragrance, Taste Component | Solution | 0-100 | 20 | | 20 |
| Vapor Pressure Modifier | Ethanol | | 0-30 | 30 | 20 | 30 |
| Nucleation Site Structures | Salts: NaCl, Dispersion | | 0-10 | 5 | 5 | 5 |
| Surfactant, Aerosol Particle Size Control | Lecithin, Tweens, etc. | | 0-5 | 3 | 3 | 3 |
| Buffer | Citrates, Phosphates | | 0-10 | 5 | 5 | 5 |

TABLE III-continued

| Functionalized Formulations | | | | | | |
|---|---|---|---|---|---|---|
| | Component | | Range | Formulation Examples (%) | | |
| Function | Example | Form | (%) | 1 | 2 | 3 |
| | Salt-Acid Pair, etc. | | | | | |
| Preservatives | Alkyl Hydroxyanisole or Hydroxytoluene, etc. | | 0-3 | 1 | 2 | 2 |
| Liquid Excipient | Water, Glycol, Glycerin, etc. | | q.s. ad | 16 | 15 | 25 |

Low Solubility/Hydrophobic Organoleptic Fragrance Delivery

A. Chemical/Thermal Aerosol Delivery Activation

Because in the practice of this invention two or more chambers, compartments or zones are used having different formulations, the invention also enables benefits resulting from their different nature to obtain further improvements in aerosol delivery. These improvements are inclusive for the embodiments disclosed in Table I, II and III above. Two specific cases are noted below:

1. Chemical Equilibrium or Chemical Reactivity Activation

According to this embodiment, the unflavored formulation may comprise a chemical component that can either react or affect another chemical component included in the downstream functionalized formulation. For example, it is known that nicotine in solution is in a chemical equilibrium as per the Brnsted-Lowry acid/base theory. Therefore, acidic or basic component—such as acetic, citric, etc., buffers— carried by the unflavored aerosol can be useful to control the ionization of nicotine in the final delivered aerosol. Therein, according to this embodiment, improvement in nicotine delivery consistency is possible. In addition, the formation in situ of fragile flavors and taste component is possible if reactants are kept separated until mixing in the aerosol vapor prior to delivery.

2. Thermal Activation

The inclusion of a chemical component in the unflavored formulation that can react with another chemical component included in the downstream formulation to exothermically or endothermically change the temperature of the aerosol. For example, water in the unflavored aerosol can react with a salt pod in the downstream portion of the e-cigarette to release heat of hydration, i.e., $CuSO_4$, etc. This heat can be used to assist in the sublimation of organoleptic in the downstream portion of the e-cigarette. Another example is the use of an endothermic reaction, i.e., $NH_4Cl$, etc. This would allow cooling of the aerosol vapor after its formation and therefore improve delivery consistency of the aerosol particle size distribution.

Figure 2:
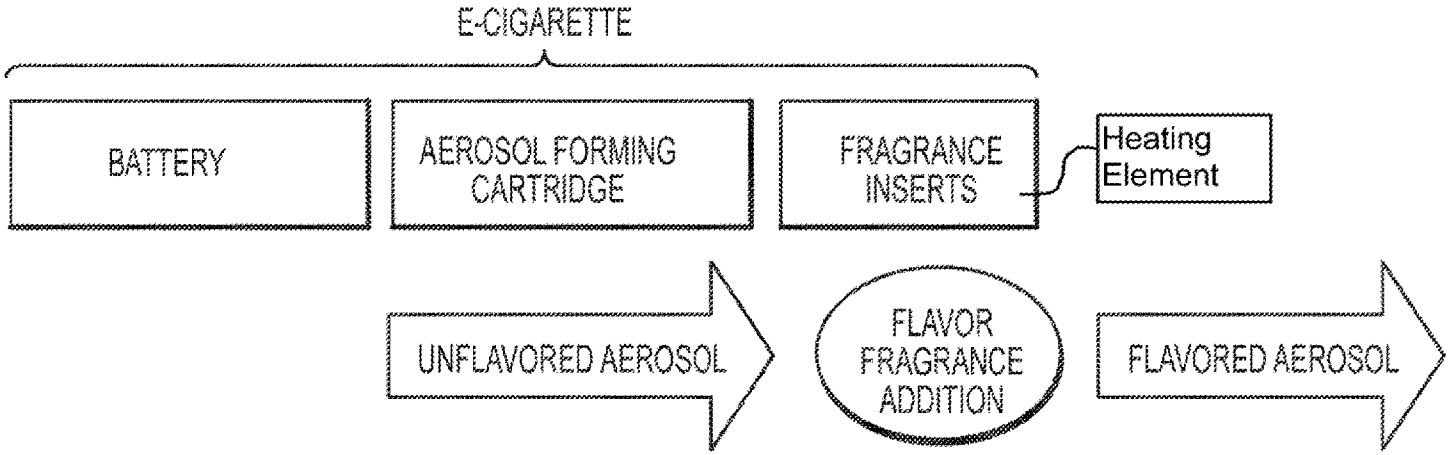
FIG. 2 is a block diagram showing an unflavored aerosol being formed and subsequently flavored.

FIG. 2 further illustrates this concept, whereby the unflavored aerosol is formed in the aerosol forming cartridge where an aerosol forming liquid is in contact with the heating element. As the aerosol moves downstream and interacts with the flavored insert, the aerosol becomes flavored. Though the sketch in FIG. 2 shows separate e-cigarette major components, it will be understood that any combination of the battery, aerosol cartridge and/or fragrance insert may be physically integrated with each other as long as the fragrance insert is disposed downstream the aerosol cartridge as indicated by the arrows.

This concept separates aerosol formation from taste, fragrance and/or nicotine delivery. Therefore, the aerosol is improved by removing any degradation of quality, nicotine delivery and taste caused by either the interaction of the aerosol forming liquid formulation with the formulation contained in the fragrance insert or its thermal degradation/inactivation when in contact with the heating element of the e-cigarette.

In addition, the fragrance formulations in the inserts can be made with a broad range of materials such as normal solutions, dispersions, emulsions, gels, creams, powders, pastes, waxes, etc. The fragrance release can occur thermally, chemically, dissolution, vapor pressure driven, moisture, electric, etc. The insert can use fabricated using one or combination of different fragrance matrixes such as surface coating, dissolvable matrix, encapsulated fragrance, wicking web, coated web, etc.

Although, this concept is based on aerosol flow dynamics, it can be further enhanced by placing a heating element in the insert to control the release of fragrance.

Figure 3:
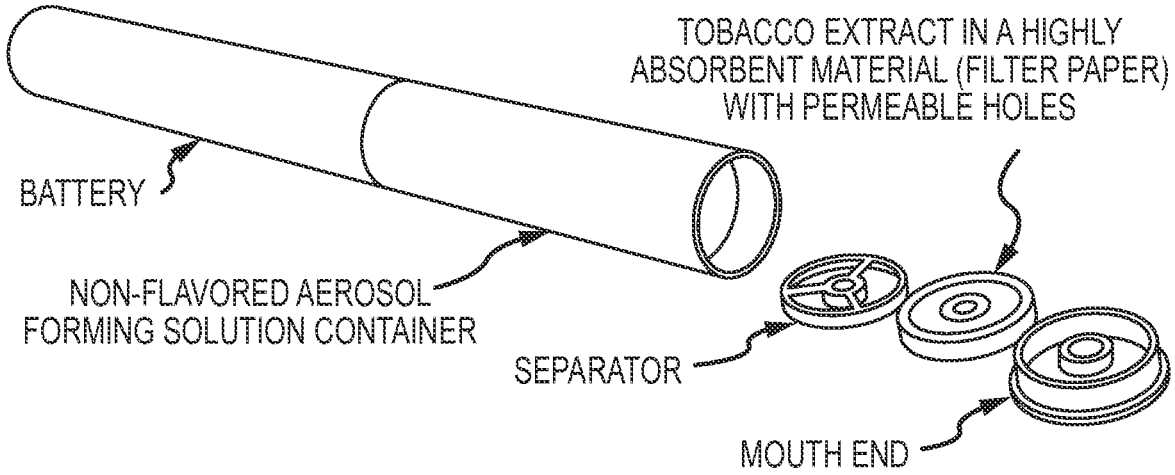
FIG. 3 is an exploded isometric view of an e-cigarette comprising a flavorant insert.

An embodiment of an apparatus of the present invention depicted below in FIG. 3 comprises an e-cigarette having a cartomizer loaded with a glycol/water solution in addition to a paper filter insert coated with tobacco extract located prior to the mouth end. The aerosol delivered under this construction tasted as 'tobacco flavored aerosol'. By way of further example, a vanilla flavored insert may be used to deliver a vanilla flavorant to aerosol delivery.

The sketches proved in the following figures illustrate numerous embodiments of the proposed inserts for the practice of the present invention. These embodiments are non-limiting, and it will be understood that the present invention may comprise combinations of one or more of these embodiments.

Figure 4:
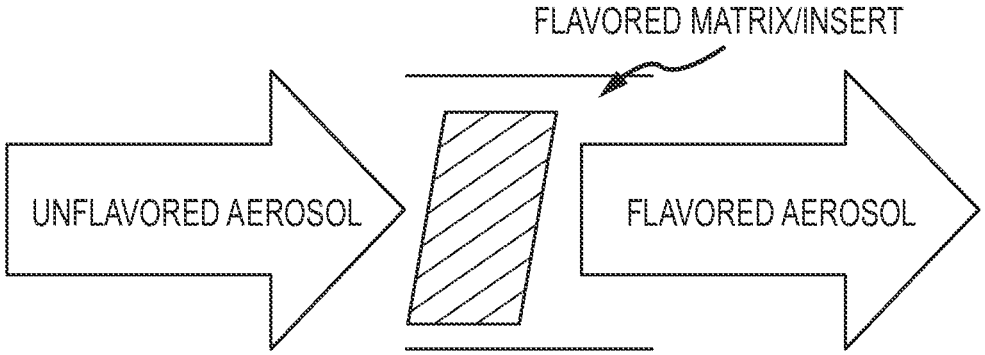
FIG. 4 is a flow diagram of one embodiment of an insert for an e-cigarette according to the disclosure.

Porous Matrix of Embedded Coated Fibers or Hollow Fibers Filled with Fragrance Formulations FIG. 4 illustrates an embodiment of the present invention comprising fragrance formulations in a porous matrix of embedded fibers. The fragrance may be coated on the fibers on contained within hollow fibers. According to this embodiment, the fragrance migrates into the aerosol stream to flavor the aerosol stream. It can be activated electrically or by dissolving a fragrance carrier. A similar release mechanism is applicable to numerous of the other embodiments described below.

Single/Multiple Layer Screen Insert Where the Screen Carries Fragrances as Coated Fibers, Fragrances as Encapsulated Fibers, Etc.

Figure 5:
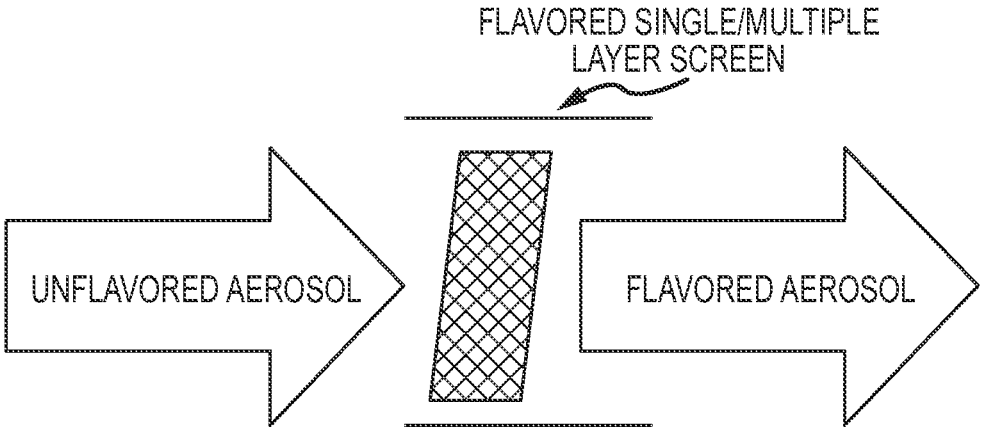
FIGS. 5-18 are flow diagrams of various embodiments of inserts for an e-cigarette according to the disclosure.

FIG. 5 illustrates an embodiment of the present invention comprising fragrances embedded in single or multiple layer screens for delivery to the unflavored aerosol vapor. According to this embodiment, for example, the release of encapsulated fragrances might be activated by water/glycol in an unflavored aerosol formulation.

Figure 6:
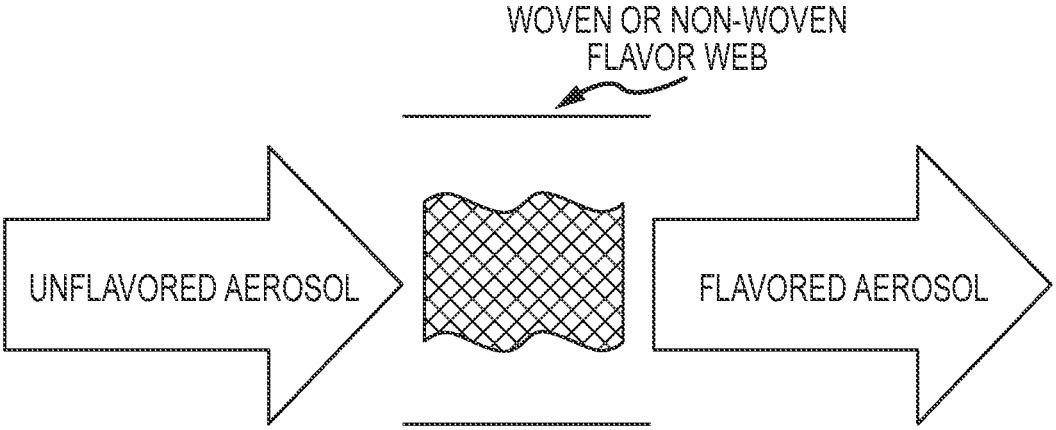

Woven or Non-Woven Web or Sheet Form with Erodible Material or any of the Previously Described Fragrance Carriers FIG. 6 illustrates an embodiment of the present invention comprising a web fabricated such that fragrances are released on interaction with the unflavored aerosol.

Diffusible and/or Erodible Disk(s)

Figure 7:
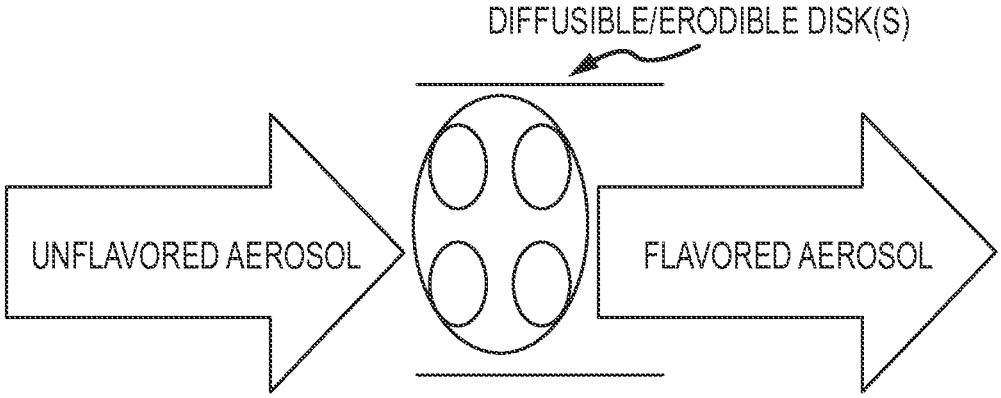

FIG. 7 illustrates an embodiment of the present invention comprising a diffusible or erodible disk containing a functionalized formulation. For example, the disk can be formulated with a fragrance in a hygroscopic matrix that erodes during inhalation.

Coil Wrapped Insert with a Coated High Area or Webbed Structure

Figure 8:
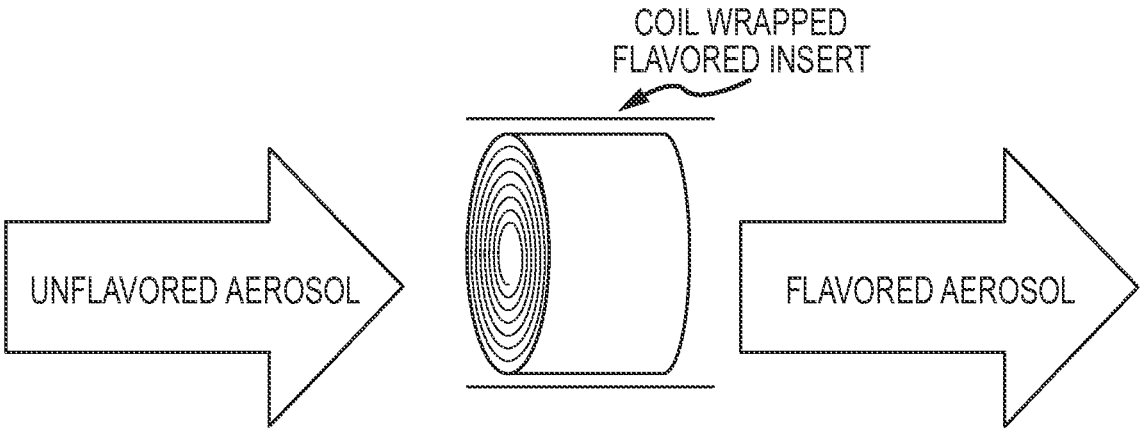

FIG. 8 illustrates an embodiment of the present invention comprising a coil wrapped insert having a coated area or webbed structure. The purpose of this design is to maximize the effective interaction between the unflavored aerosol and the flavoring insert. This design is also applicable to several of the embodiments disclosed herein.

Porous Membrane or Open Cell Foam/Sponge

Figure 9:
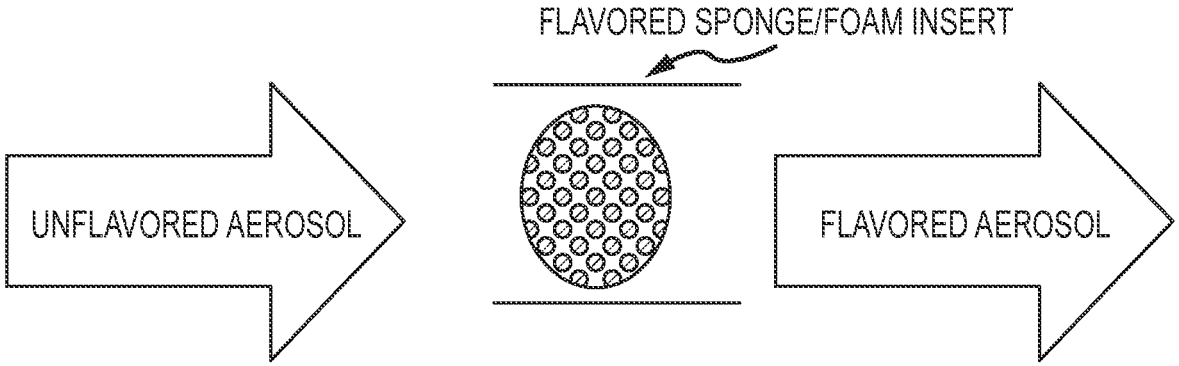

FIG. 9 illustrates an embodiment of the present invention comprising the use of a porous membrane or open cell foam/sponge structure The porous membrane can be made of cellulose or any other highly absorbing material applicable for fragrance/nicotine carrying. The e-cigarette shown in FIG. 3 with a tobacco extract embedded material placed toward the mouth end is an embodiment of this design.

Plaited Flavor Coated Insert

Figure 10:
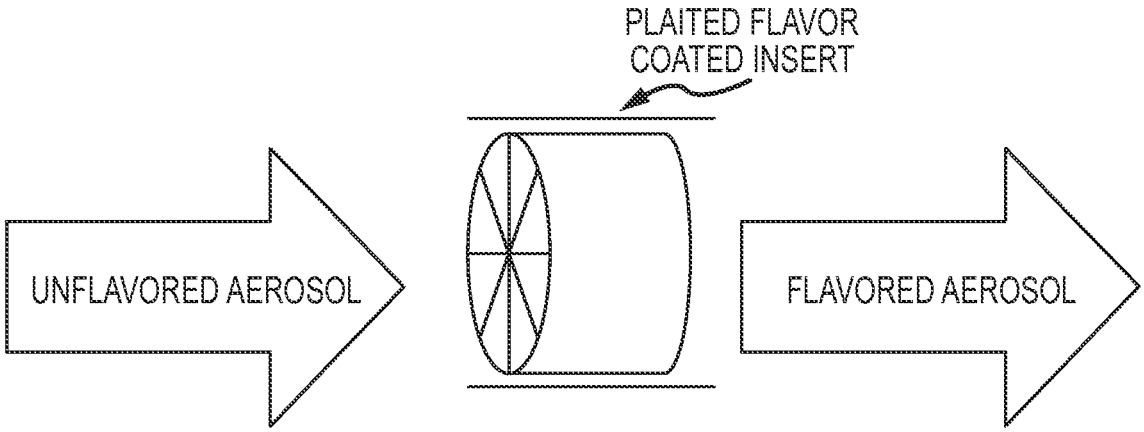

FIG. 10 illustrates an embodiment of the present invention comprising a plaited flavor coated insert. In addition of maximizing the effective interaction area for the un-flavored aerosol and the flavoring insert, this plaited design benefits from venturi acceleration to drive fragrance into the aerosol stream.

3-Dimensional Flavor Coated Insert

Figure 11:
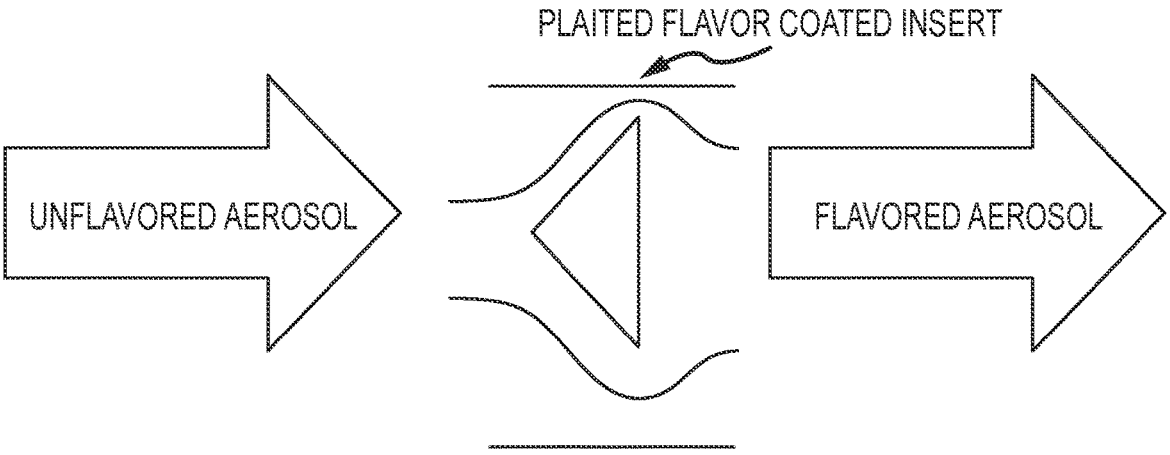

FIG. 11 illustrates an embodiment of the present invention comprising a configured flavor coated insert. In addition to the ease of construction of a solid insert, the insert can be fabricated from an erodible fragrance/nicotine matrix. One or multiple flow path can be used to control the flow dynamic and maximize the impacting energy of the unflavored aerosol on the flavoring insert.

Tube Bundles

Figure 12:
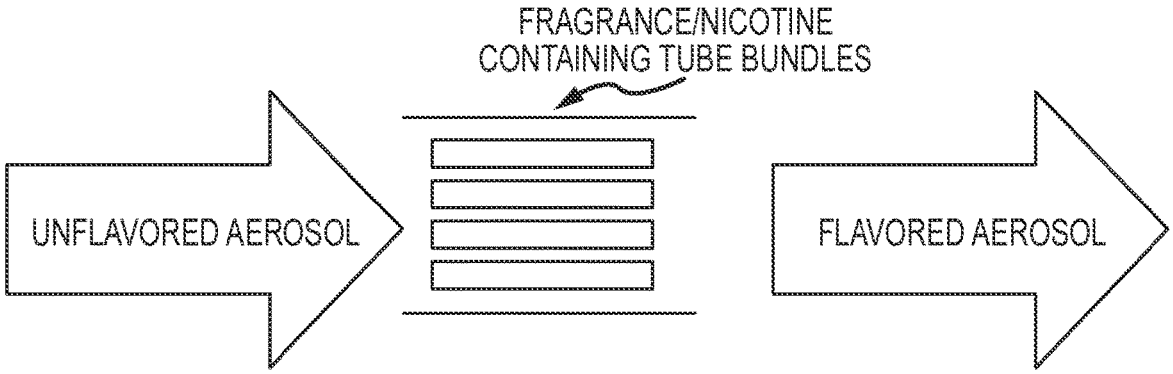

FIG. 12 illustrates an embodiment of the present invention comprising bundled tubes containing fragrances/nicotine that is releasable on differential pressure, temperature or electrical activation. Inhalation can also be a fragrance releasing force.

Fragrance/Nicotine Coated Channel in a Honeycomb Insert

Figure 13:
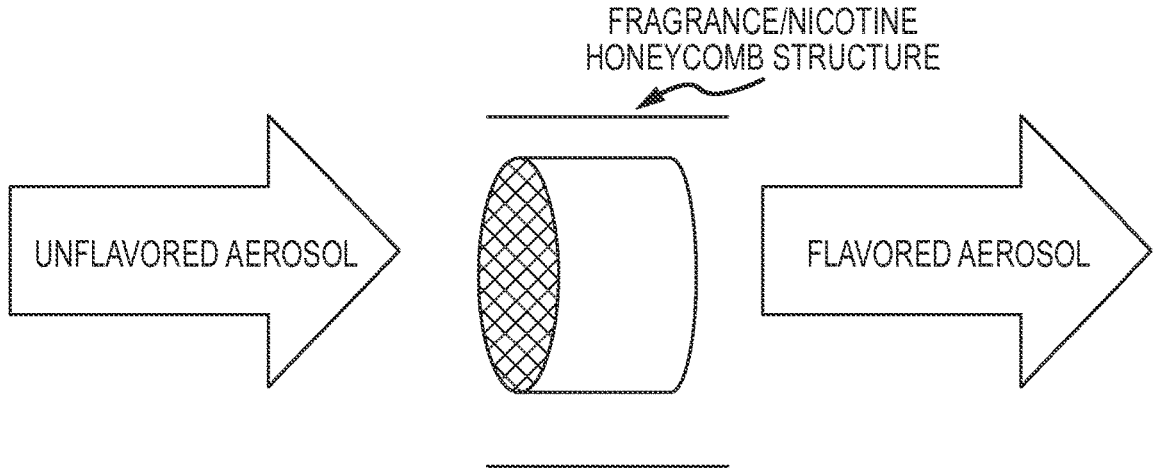

FIG. 13 illustrates an embodiment of the present invention comprising a honeycomb cell structure with fragrance/nicotine pods. Control of release can be obtained by having different releasing rates distributed among the honeycomb cells. This concept of controlling the fragrance releasing rate by changing the rate of activation across the flavoring insert is applicable to other embodiments of the present invention.

Fragrance Release by Inhalation—I

Figure 14:
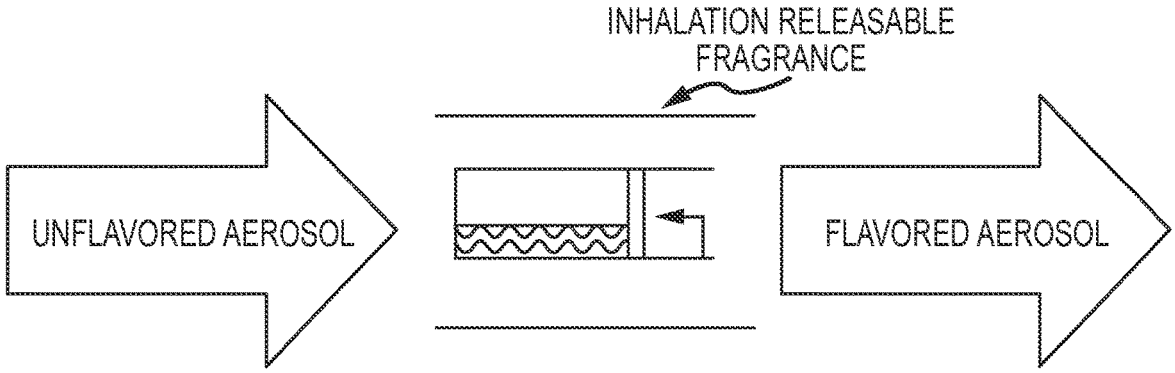

FIG. 14 illustrates an embodiment of the present invention comprising a capsule containing fragrance/nicotine which releases its load under inhalation pressure. This approach can be used to change the flagrance as an OFF/ON flavor option. Although FIG. 14 shows the flavoring of an unflavored aerosol stream, it is also applicable for changing the flavor of a flavored aerosol. This insert can be used sequentially. These concepts are also applicable below to the embodiments directed to fragrance release by inhalation or by being physically crushed.

Fragrance Release by Inhalation or Physically Crushed—II

Figure 15:
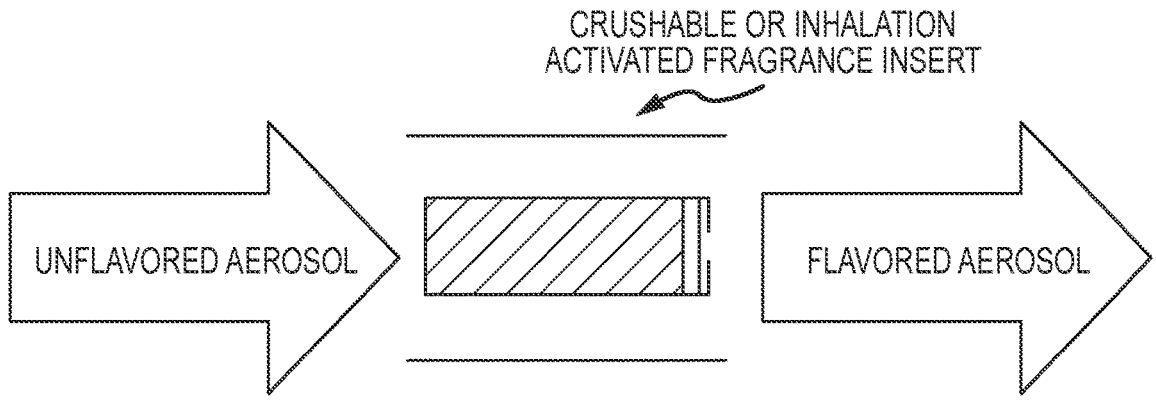

FIG. 15 illustrates an embodiment of the present invention comprising a fragrance insert that can be broken under inhalation pressure or by being physically crushed to release fragrance into the aerosol stream.

Fragrance Releasing Non-Web/Web Pouch

Figure 16:
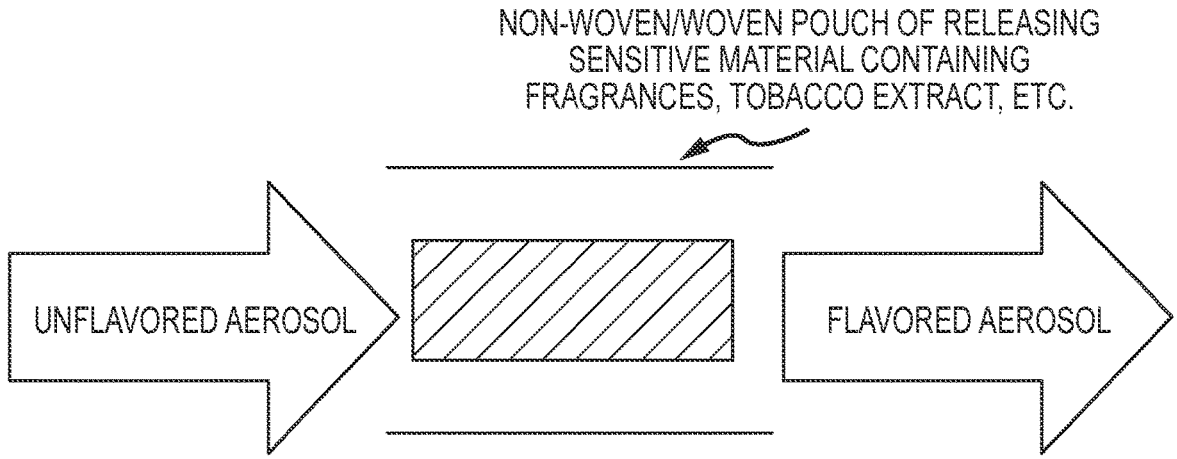

FIG. 16 illustrates an embodiment of the present invention comprising a pouch having a non-woven web of non-woven sensitive material normally having interstices capable of passing smoke upon activation. The web is compressed and bonded, while compressed, to hold the fibers in compressed condition filling the interstices to prevent passage of its load outwardly thereof. The payload can be fragrance(s), tobacco extract, nicotine delivery enhancing chemical material(s)s, or other material(s) desired for modification of the unflavored aerosol. The pouch releases its load on puncturing. The web can react or dissolve with one or more chemical components in the unflavored aerosol to be activated. Therefore, the pouch formulation provides the benefit of improved shelf life by being protected from interaction with the environment and with each other prior to usage.

Fragrance Releasing Poach

Figure 17:
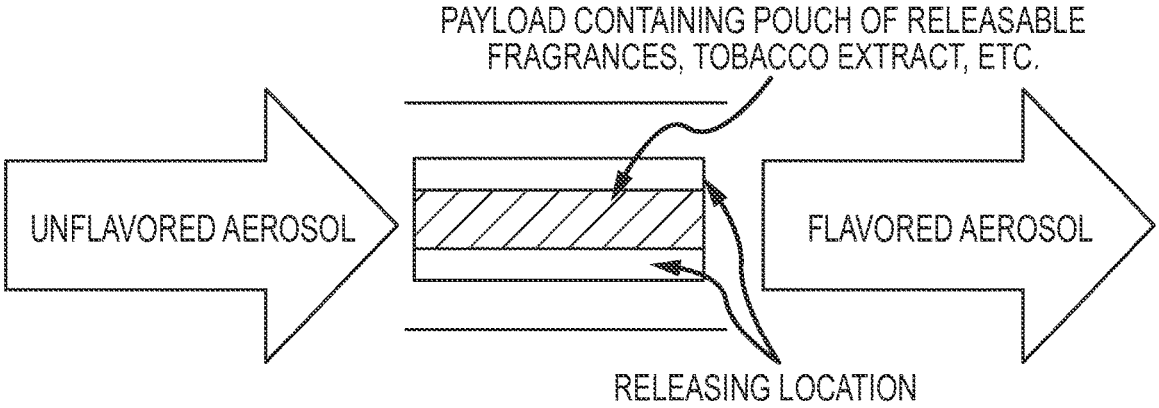
Figure 18:
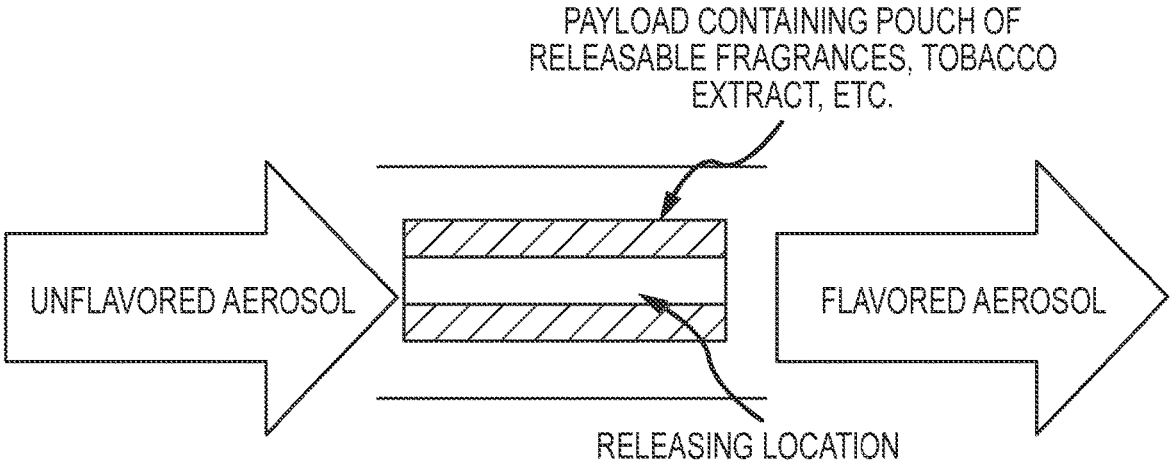

FIGS. 17 and 18 illustrate embodiments of the present invention comprising a pouch containing a payload. The load can be fragrance(s), tobacco extract(s), nicotine(s), nicotine delivery enhancing chemical materials, or other material(s) desired for the modification of the aerosol organoleptic properties. This pouch releases its load on mechanical, thermal activation or similar mixing mechanism such as puncturing, crushing, opening a valve, etc. Because the pouch formulation is within a sealed container, the users have an ON/OFF option of using it to modify the aerosol organoleptic experience. This invention is inclusive of the use of multiple pouches or chambers placed in a carrousel arrangement in alignment with the aerosol stream such that users can select a particular flavor to be delivered during usage of the e-cigarette. In addition, the formulations benefit of improved shelf life by being protected from interaction with the environment and with each other prior to usage.

What is claimed is:

1. An e-cigarette comprising:

a cartomizer; and a battery;

wherein the cartomizer comprises a glycol and water solution, wherein the cartomizer comprises an aerosol formation mechanism configured to create an aerosol from the glycol and water solution, and an insert configured to deliver a flavor to an aerosol created by the cartomizer, wherein the insert comprises a heating element configured to assist in the release of the flavor, wherein the insert further comprises a honeycomb cell structure comprising a plurality of honeycomb cells, and wherein the honeycomb cell structure is configured to have varying release rates within the plurality of honeycomb cells.

2. The e-cigarette of claim 1 wherein the flavor is configured to be delivered by a fragrance formulation operatively associated with a porous matrix of embedded fibers.

3. The e-cigarette of claim 2 wherein the fragrance formulation can be electrically activated.

4. The e-cigarette of claim 1 wherein the flavor is configured to be delivered by a fragrance formulation operatively associated with at least one screen.

5. The e-cigarette of claim 4 wherein the fragrance formulation is configured to activated by the glycol and water solution.

6. The e-cigarette of claim 1 wherein the insert comprises a diffusible disk comprising a functionalized formulation.

7. The e-cigarette of claim 6 wherein the functionalized formulation comprises a hygroscopic matrix that is configured to erode during inhalation.

8. The e-cigarette of claim 1 wherein the flavor is configured to be delivered by a plaited flavor coated insert.

9. The e-cigarette of claim 1 wherein the insert is a 3-Dimensional flavor coated insert.

10. The e-cigarette of claim 1 wherein the insert comprises an erodible fragrance/nicotine matrix.

11. The e-cigarette of claim 1 wherein the insert comprises a tube bundle.

12. The e-cigarette of claim 11 wherein the flavor is configured to be released from the tube bundle by differential pressure activation.

13. The e-cigarette of claim 11 wherein the flavor is configured to be released from the tube bundle by temperature activation.

14. The e-cigarette of claim 1 wherein the insert comprises a fragrance, a vapor pressure modifier, a preservative, and an excipient.

15. A method of forming an aerosol vapor comprising:

generating an aerosol from an aerosol forming liquid with a cartomizer in an e-cigarette; and functionalizing the aerosol by subjecting the aerosol to an insert that has a wrapped structure and a flavor coated area for the purpose of transferring one or more organoleptic properties to the aerosol, wherein the insert comprises a heating element configured to assist in transferring the one or more organoleptic properties to the aerosol, wherein the insert further comprises a honeycomb cell structure comprising a plurality of honeycomb cells, and wherein the honeycomb cell structure is configured to have varying release rates within the plurality of honeycomb cells.

16. The method of forming an aerosol of claim 15 wherein generating an aerosol further comprises providing an optimal aerosol particulate size distribution for the desired transferred organoleptic properties.

17. The method of forming an aerosol of claim 15 wherein the aerosol forming liquid comprises an excipient for activating chemical reactions during the functionalizing step.

18. The method of forming an aerosol of claim 17 wherein the excipient comprises a water solution.

* * * * *